US005611390A

United States Patent [19]

Benedetti et al.

[11] Patent Number: 5,611,390

[45] Date of Patent: Mar. 18, 1997

[54] CONTINUOUS-CASTING CRYSTALLISER WITH INCREASED HEAT EXCHANGE AND METHOD TO INCREASE THE HEAT EXCHANGE IN A CONTINUOUS-CASTING CRYSTALLISER

[75] Inventors: Giampietro Benedetti, Campoformido; Milorad Pavlicevic, Udine; Gianni Gensini, S.Stefano di Buia; Alfredo Poloni, Redipuglia, all of Italy

[73] Assignee: Danieli & C. Officine Meccaniche SpA, Buttrio, Italy

[21] Appl. No.: 470,454

[22] Filed: Jun. 6, 1995

[30] Foreign Application Priority Data

Jun. 6, 1994 [IT] Italy ..... UD94A0096
Feb. 6, 1995 [IT] Italy ..... UD95A0014

[51] Int. Cl.[6] ..... B22D 11/04; B22D 11/22

[52] U.S. Cl. ..... 164/485; 164/418; 164/443

[58] Field of Search ..... 164/418, 435, 164/443, 485

[56] References Cited

U.S. PATENT DOCUMENTS

| | | |
|---|---|---|
| 3,520,352 | 7/1970 | Hess . |
| 4,699,200 | 10/1987 | Sedlacek . |

FOREIGN PATENT DOCUMENTS

| | | | |
|---|---|---|---|
| 2223115 | 10/1974 | France . | |
| 2584322 | 1/1987 | France . | |
| 2661120 | 10/1991 | France . | |
| 730079 | 1/1943 | Germany . | |
| 1916503 | 1/1970 | Germany . | |
| 1558385 | 2/1970 | Germany . | |
| 2106634 | 8/1972 | Germany . | |
| 3423475 | 11/1984 | Germany . | |
| 4127333 | 2/1993 | Germany . | |
| 54-36900 | 11/1979 | Japan | 164/418 |
| 59-35856 | 2/1984 | Japan . | |

OTHER PUBLICATIONS

Patent Abstracts of Japan, vol. 008, No. 136M304 23 Jun. 1984 & JP A 59 035856 (27 Feb. 1984) Kawasaki Seitetsu KK).

Patent Abstracts of Japan vol. 7, No. 271 M–260 (1416) Dec. 3, 1983 & JP A–58–151943 Mishima Kousan KK 9/83.

Metallurgical Transactions B. Process Mettallurgy, vol. 13B, No.1 3/82, pp. 91–104 Samarasekera et al "The Thermal Distortion of Continuous–Casting Billet Molds".

(List continued on next page.)

*Primary Examiner*—J. Reed Batten, Jr.
*Attorney, Agent, or Firm*—Antonelli, Terry, Stout & Kraus, LLP

[57] ABSTRACT

The crystalliser (11) cooperates externally with a box-shaped structure (13) creating cooling chambers (14), in which a cooling fluid circulates, and cooperates internally with the skin of the billets, blooms or slabs (24) being formed. The cooling chambers (14) containing intermediate walls (20) create circulation channels (21) in cooperation with the outer surfaces (12) of the sidewalls of the crystalliser (11), at least one upper zone (34) being included in cooperation at least with the vicinity of the meniscus and with the portion below the meniscus (33) of liquid metal, a lower zone (26) being also included and beginning in the vicinity of the zone of separation of the forming skin from the inner surfaces (12) of the crystalliser (11) and extending towards the outlet of the crystalliser (11). By acting on the cross-section and/or conformation of at least one longitudinal portion of at least one side of the cross-section of the circulation channels (21), e.g., by providing elements to disturb the flow of cooling fluid in the circulation channels (21), and by acting on the different pressures of the cooling fluid present between the inlet and outlet of that longitudinal portion of the circulation channels (21) a desired turbulence of the cooling fluid is created which is such as to increase the coefficient of heat exchange to a value greater than 40,000 $W/m^2K$. The side walls of the crystallizer preferably have a thickness between 4 and 15 mm.

22 Claims, 3 Drawing Sheets

FOREIGN PATENT DOCUMENTS

| | | | |
|---|---|---|---|
| 61-209748 | 9/1986 | Japan | 164/418 |
| 6-79411 | 3/1994 | Japan | 164/443 |
| 54648 | 3/1968 | Poland | 164/418 |
| 668776 | 7/1979 | U.S.S.R. | 164/443 |
| 952422 | 8/1982 | U.S.S.R. | 164/443 |
| 1281339 | 1/1987 | U.S.S.R. | 164/418 |
| 1183883 | 3/1970 | United Kingdom . | |
| 2016977 | 9/1979 | United Kingdom . | |
| 2156252 | 10/1985 | United Kingdom . | |
| 2177331 | 1/1987 | United Kingdom | 164/418 |

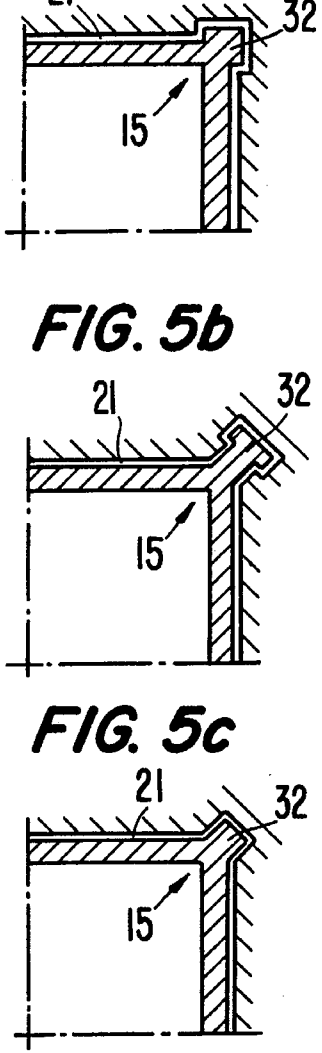
FIG. 5a
FIG. 5b
FIG. 5c
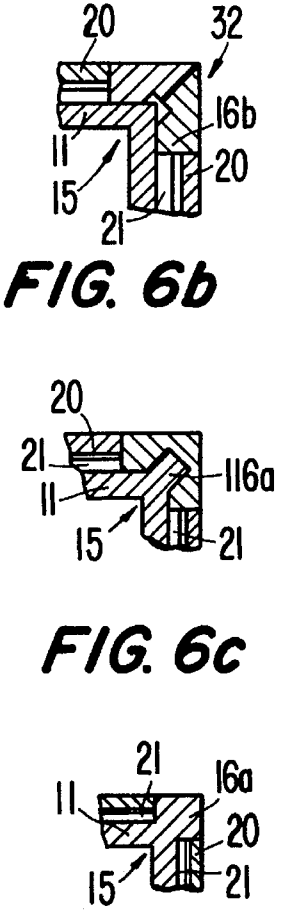
FIG. 6a
FIG. 6b
FIG. 6c
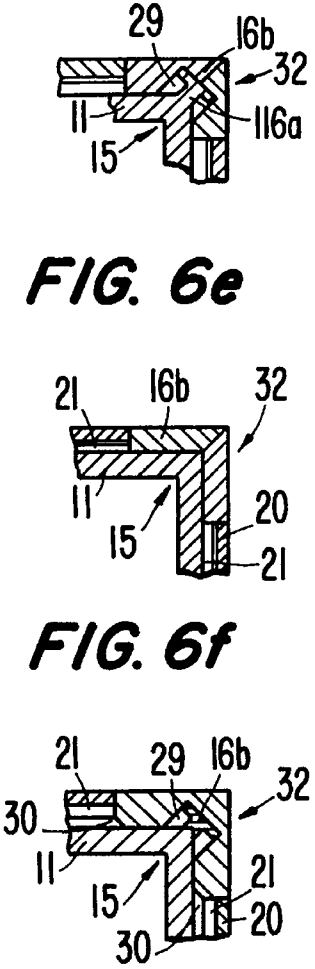
FIG. 6d
FIG. 6e
FIG. 6f

CONTINUOUS-CASTING CRYSTALLISER WITH INCREASED HEAT EXCHANGE AND METHOD TO INCREASE THE HEAT EXCHANGE IN A CONTINUOUS-CASTING CRYSTALLISER

BACKGROUND OF THE INVENTION

This invention concerns a continuous-casting crystalliser with increased heat exchange and also a method to increase the heat exchange in a continuous-casting crystalliser.

The invention is employed in association with a mold used in a continuous casting plant for the production of billets, blooms or slabs of any desired type and section.

The field of continuous casting still entails a plurality of problems which have not yet been overcome and which are linked to the high temperatures to which the sidewalls of the crystalliser are subjected.

To be more exact, it is known that the temperature of the sidewalls of the crystalliser, notwithstanding the circulation of cooling fluid, changes in the direction of the casting with a maximum value reached in the vicinity of the meniscus of the molten metal.

The uneven temperature along the sidewalls of the crystalliser causes an uneven deformation of those sidewalls together with their outward displacement in relation to their initial position in the cold state, this deformation being due to the thermal expansion of the material, with resulting problems linked to the surface faults caused by this uneven deformation on the billets/blooms/slabs being formed.

Moreover, it is known that the skin of the solidifying billets/blooms/slabs during their descent in the crystalliser shrinks according to a law which differs from one material to another.

The combination of these two factors causes, at least in the lower zone of the crystalliser, a separation of the skin of the billet/bloom/slab from the sidewalls of the crystalliser and reduces considerably the heat exchange between the billet/bloom/slab and the crystalliser to the extent that the cooling and therefore the formation of the skin are practically halted with very severe results for the billet/bloom/slab being formed.

In the crystallisers of the state of the art the coefficient of heat exchange between the forming skin and the sidewalls of the crystalliser, at least in the lower zone of the crystalliser, takes on values which are lower than 36000 $W/m^2K$ and which are therefore not acceptable for an efficient action of cooling and therefore of solidification of the skin being formed.

The article of J. K. BRIMACOMBE "Empowerment with Knowledge—Towards the Intelligent Mould for the Continuous Casting of Steel Billets", METALLURGICAL TRANSACTIONS B, Volume 24B, DECEMBER 1993, pages 917–930, shows clearly that in crystallisers of the state of the art the heat flux in the zone of the exit of the cast product from the crystalliser is between about 1.2 and 1.4 $MW/m^2$, whereas it does not exceed 2 $MW/m^2$ in the zone where the separation of the skin from the sidewalls of the crystalliser begins.

In the crystallisers of the state of the art, therefore, the heat exchange has acceptable values only along the first segment of the crystalliser, which extends along about a quarter of the length of a crystalliser and normally about 200 mm. below the meniscus; in this first segment the skin of the billet/bloom/slab is substantially in contact with the sidewalls of the crystalliser.

So as to ensure that the billet/bloom/slab leaving the crystalliser has a thickness of skin such as to prevent its breakage and the resulting break-out of liquid metal, it is therefore necessary to employ a reduced casting speed.

Where the billets or blooms have a square, rectangular or generally polygonal cross-section, another problem is linked to the fact that the corners of the billet or bloom undergo a more intense cooling since at those corners the heat is removed on both sides of the corner.

The result is that at the corners of the billet or bloom the skin forms more quickly and the resulting shrinkage of the material has the effect that the billet or bloom is separated very soon from the sidewalls of the crystalliser, thus interrupting the cooling and solidifying process.

For this reason the skin of the billet or bloom at the corners is less thick than along the sidewalls of the billet or bloom, and gradients of temperature between the corners and the sides of the billet or bloom are created.

These temperature gradients generate tensions both within the sidewalls of the crystalliser and within the billet or bloom being cooled, and these tensions lead to the formation of cracks and other surface faults which reduce the quality of the outgoing product.

SUMMARY OF THE INVENTION

The present applicants have designed, tested and embodied this invention to overcome the shortcomings of the state of the art and to achieve further advantages.

The purpose of this invention is to obtain a crystalliser for the continuous casting of billets/blooms/slabs which enables the extraction speed to be increased owing to an increased heat exchange between the sidewalls of the crystalliser and the cooling fluid.

A further purpose is to provide a crystalliser in which the thermal deformation of that crystalliser is reduced to a minimum.

Yet another purpose is to provide a method which enables the heat exchange to be increased between the sidewalls of the crystalliser and the skin being formed in a continuous-casting crystalliser.

The crystalliser according to the invention has sidewalls of a reduced thickness, between 4 and 15 mm., but advantageously between 4 and 10 mm., which enable their behaviour to be made resilient.

This resilient behaviour of the crystalliser enables a greater quantity of heat to be extracted than with rigid crystallisers of the state of the art since this behaviour enables the sidewalls to be displaced inwards, thus cancelling the deformation due to the thermal field, which instead expands the sidewalls outwards.

In this way the interspace of air between the sidewalls and the skin being formed is cancelled, thus reducing the very high thermal resistance, calculated as being about 84% of the total thermal resistance, which this interspace creates in the heat exchange between the sidewalls of the crystalliser and the cast product.

This reduction or cancellation of the interspace makes possible, even in the lower zone of the crystalliser, an extraction of a very great heat flux between 2.5 and 5 $MW/m^2$.

Such a heat flux would entail very high temperatures of the sidewalls of the crystalliser, temperatures which could lead to plastic deformation of the sidewalls.

Since it is necessary in that lower zone to stay in a condition of resilience of the sidewalls so as to be able to cancel the air interspace created with the forming skin, it becomes necessary to increase the coefficient of heat exchange between the cooling fluid and the sidewalls of the crystalliser to a value between 40,000 and 100,000 $W/m^2K$ so as to be able to remove the very high heat flux which is created.

The sidewalls of the crystalliser cooperate externally with cooling chambers, which contain a specific intermediate wall for each sidewall of the crystalliser for the purpose of defining together with that sidewall a circulation channel for the cooling fluid.

According to one form of embodiment of the invention the circulation channels have, perpendicular to the axis of the crystalliser, a section having a transverse length shorter than the sidewalls of the crystalliser and a transverse width, or span, of the passage for the cooling fluid having a maximum value of 3 millimeters.

The scope of the invention comprises the correlation of the pressure or range of pressures of the cooling fluid circulating in the relative circulation channels with the value of the coefficient of heat exchange to be achieved between the sidewalls of the crystalliser and the cooling fluid.

The invention arranges that by acting on the pressure of the cooling fluid it is possible to deform the sidewalls of the crystalliser in the desired zones in the desired manner.

In this invention, by cooling fluid is meant water for industrial use, at any rate water which is normally used in molds to cool the crystalliser.

According to a variant the invention arranges to employ as a cooling fluid water to which has been added substances which enable that water to be used even at temperatures of entry into the mold lower than "0" and down to −25° C./−30° C.

A variant of the invention arranges for the use, as a cooling fluid, of other liquid substances such as glycol, for instance, at a temperature between −10° C./−15° C. and −70° C./−80° C. upon entry into the mold.

A further variant of the invention covers the use, as a cooling fluid, of liquefied gases, whether pure or combined with other gases or liquids, at a temperature between −3° C. and −270° C. upon entry into the mold.

Hereinafter, the various parameters given refer to a cooling fluid consisting of one of the various types of water, also called normal water, as normally used to cool continuous casting molds in an industrial process.

According to the invention, depending on the case in question, the cooling fluid can flow in the same direction as, or in the opposite direction to, the direction of feed of the billet/bloom within the casting chamber.

The combination of the resiliently working sidewalls and the differentiated pressure of the cooling fluid acting on those sidewalls makes possible a considerable reduction, or even the elimination, of the separation of the skin of the solidifying billet/bloom/slab from the sidewalls of the crystalliser, thus ensuring a constantly great heat exchange.

Since the thickness of the skin of the billet/bloom/slab is in proportion to the quantity of heat removed, the greater the heat exchange is, the greater the casting speed will be.

When other conditions are equal, the crystalliser according to the invention therefore makes possible an increase of the casting speed, with a resulting increase of the output of the plant.

According to a possible form of embodiment of the crystalliser according to the invention the circulation channels do not affect the corner zones of the crystalliser so as to prevent causing an excessive cooling of the corners of the billet/bloom/slab being formed in cooperation with those corner zones.

In that case the crystalliser according to the invention includes at the corners stiffening elements suitable at least to control the deformations of the crystalliser caused by the thermal expansion as a result of the heating of the crystalliser.

These stiffening elements are wholly or partially embodied directly in the crystalliser itself or are auxiliary external elements which are secured to, or are caused to cooperate with, the corners of the crystalliser.

The stiffening elements may be in contact with the corners of the crystalliser so as to determine a no transit area therefore not lapped by the circulation of the cooling fluid.

According to a variant a passage is included between the stiffening elements and the corners of the crystalliser so as to permit the passage of the cooling fluid in a smaller quantity than at the remaining parts of the sidewalls of the crystalliser.

According to another variant the stiffening elements determine at the corners a particular geometry suitable to increase the turbulence of the cooling fluid and to optimise the alignment of the crystalliser.

According to the invention, so as to increase the heat exchange between the cooling fluid and the sidewalls of the crystalliser, the cross-section of the passage of the cooling fluid is reduced in such as way as to leave a transverse width, or span, between 1.5 and 2.5 millimeters for instance, such as will create a required turbulence and stirring in cooperation with the induced differences of pressure.

According to the invention, so as to increase the heat exchange between the cooling fluid and the sidewalls of the crystalliser, at least part of at least one face of each circulation channel includes means to disturb the flow of cooling fluid, these disturbing means being suitable to break up the fluid streams and to maintain a condition of great turbulence.

According to one embodiment of the invention at least part of the outer surface of the sidewalls of the crystalliser in contact with the cooling fluid cooperates by means of its own flow disturbing means which, by breaking up the fluid streams of the outermost layer running against the sidewalls of the crystalliser, cause the cooling fluid to run in a turbulent manner with a resulting increase of heat exchange.

The disturbing means can be embodied by means of rough areas, hollows or ridges provided on the outer surface of the sidewalls of the crystalliser and/or on the inner surface of the intermediate walls.

These hollows may be substantially horizontal or inclined in relation to the direction of flow of the cooling fluid, depending on the effect to be achieved.

According to the invention the hollows can have a development parallel or not parallel to each other.

According to a variant at least part of the inner surface of the intermediate walls facing the crystalliser and defining the circulation channels contains alternate narrowings and enlargements, which compel the cooling fluid to carry on a turbulent and swirling motion that assists in breaking up the fluid streams of the outermost layer of the fluid and improves the heat exchange with the sidewalls of the crystalliser.

According to a variant the rough surface areas can be produced by sanding, shot-blasting or an analogous treatment applied to the inner surface of the intermediate walls and/or to the outer surface of the sidewalls of the crystalliser.

In a particular form of embodiment of the crystalliser according to the invention the intermediate walls in the circulation channels are movable perpendicularly to the sidewalls of the crystalliser and cooperate with adjustment means for their approach to, or distancing from the sidewalls of the crystalliser so as to alter the transverse width or span of the circulation channels and therefore the cross-section of the passage for the cooling fluid when that fluid cooperates directly with the outer surface of the sidewalls of the crystalliser.

It is possible in this way to adjust the pressure and speed of the cooling fluid within the circulation channels.

According to the invention, when the cooling fluid consists of normal water, the pressure of the cooling fluid is between 5 and 20 bar at least at the inlet of the circulation channel at the lower zone of the crystalliser, where the forming skin is detached from the sidewalls of the crystalliser, whereas in the segment of the circulation channel in the upper zone of the crystalliser the pressure is between about 3 and 15 bar.

BRIEF DESCRIPTION OF THE DRAWINGS

The attached figures are given as a non-restrictive example and show some preferred embodiments of the invention as follows:

FIGS. 5*a*, 5*b* and 5*c* show possible forms of embodiment of the corners of the crystalliser according to the invention;

FIGS. 6*a* to 6*f* show partial cross-sections of six of the possible forms of embodiment of the stiffening elements associated with the corners of the crystalliser;

DETAILED DESCRIPTION OF THE PREFERRED EMBODIMENTS

Figure 7:
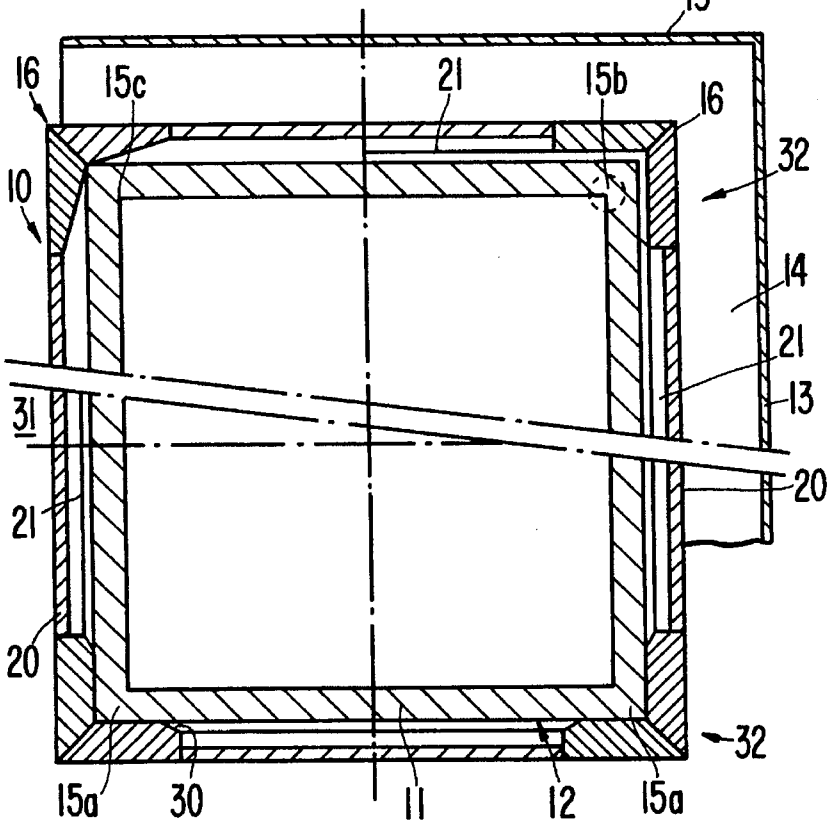
FIG. 7 shows in an enlarged scale a cross-section of a crystalliser according to the invention.

The reference number 10 in the attached figures denotes generally a mold according to the invention, with which a nozzle 25 to discharge molten metal is caused to cooperate.

The mold 10 can have a square, rectangular or polygonal cross-section or any desired cross-section.

The mold 10 according to the invention comprises a crystalliser 11 the sidewalls of which have a thickness between 4 and 15 mm., but advantageously between 4 and 10 mm.

The thickness of the sidewalls is always correlated with the range of pressures of the cooling fluid which are used to obtain a substantially resilient behaviour.

The crystalliser 11 comprises substantially an upper zone 34, which corresponds to the vicinity of the meniscus 33 and to the zone therebelow as far as the skin being formed of the bloom/billet/slab 24 is supported substantially against the inner surfaces of the crystalliser 11.

According to the invention the cooling fluid, when it is normal water, has a pressure between 3 and 15 bar in the upper zone 34.

The crystalliser 11 includes therebelow a lower zone 26, which begins substantially in the vicinity of the point where the forming skin of the bloom/billet/slab 24 being extracted begins to be separated from the inner surfaces of the crystalliser 11 and extends to the end of the crystalliser 11.

The mold 10 according to the invention comprises containing walls 13 positioned outside the crystalliser 11 and defining therewith one or more cooling chambers 14 in which a cooling fluid under pressure is caused to run.

According to the requirements of heat exchange between the cooling fluid and the crystalliser 11 and therefore in relation to the process of cooling and solidification of the billet/bloom/slab 24 being formed, the cooling fluid can be caused to run in the opposite direction to, or in the same direction as, the direction of feed of the billet/bloom/slab 24 being formed.

In this case the cooling chambers 14 include a feeder conduit 22*a* equipped with an adjustment valve 23*a* and a discharge conduit 22*b* also equipped with an adjustment valve 23*b*.

Figure 1:
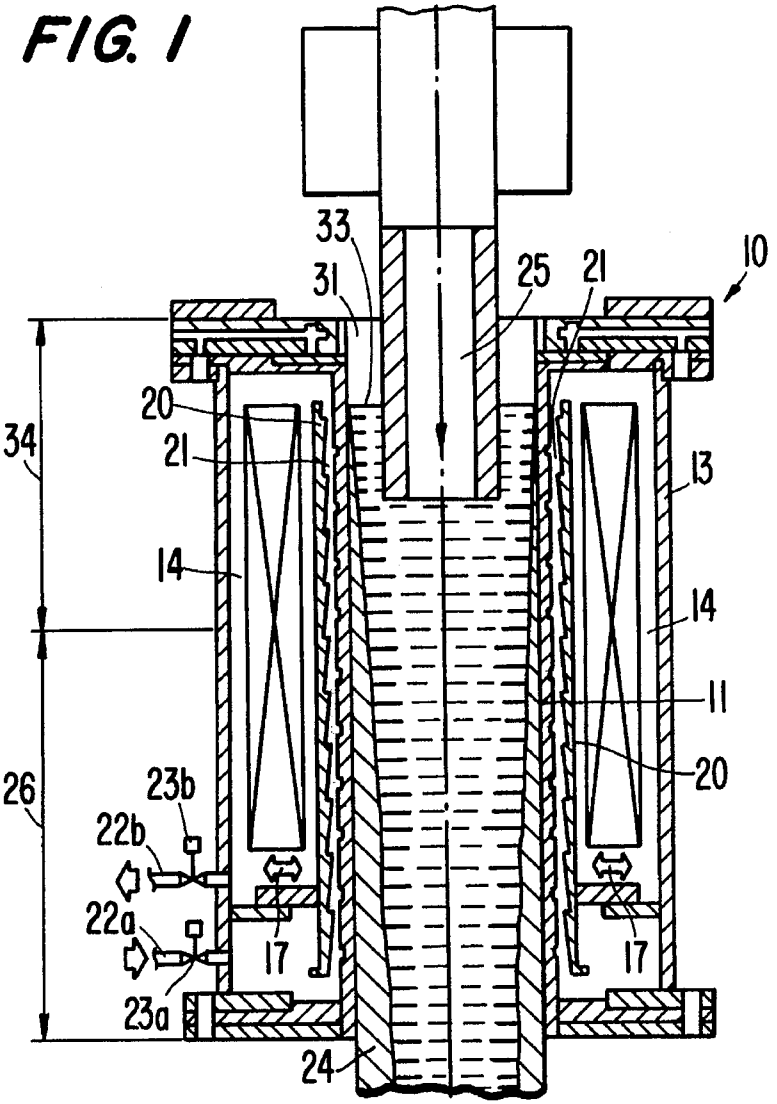
FIG. 1 shows a longitudinal section of a mold employing a crystalliser according to the invention.

In the mold 10 according to the invention these cooling chambers 14 contain, for each side of the crystalliser 11, specific intermediate walls 20, which in the example of FIG. 1 are movable transversely according to the arrows 17.

These intermediate walls 20 may also contain holes, which have the purpose of controlling the pressure of the cooling fluid in circulation channels 21.

The circulation channels 21 are included, at least one per each side of the crystalliser 11, between the intermediate walls 20 and the outer surface 12 of the sidewalls of the crystalliser 11.

By positioning the intermediate walls 20 perpendicularly to the axis of the crystalliser it is possible to alter the transverse width, or span, of the respective circulation channels 21 and therefore the hydraulic conditions of the flow of cooling fluid.

The crystalliser 11, being heated by the effect of the liquid metal running within the casting chamber 31, is outwardly deformed resiliently, and the pressure of the cooling fluid acts to compensate this deformation by displacing the sidewalls of the crystalliser 11 inwards.

By changing the pressure of the cooling fluid circulating within the cooling chambers 14 and therefore within the circulation channels 21, it is possible to cause the sidewalls of the crystalliser 11 to adhere substantially to the skin of the billet/bloom/slab 24 even in the lower zone 26 of the crystalliser 11, thus eliminating the air space being created and thus ensuring a high coefficient of heat exchange along the whole length of the crystalliser 11.

According to the invention by varying the difference of the pressure of the cooling fluid between the inlet and outlet of the circulation channels 21 it is possible to alter the heat exchange between the sidewalls of the crystalliser 11 and the cooling fluid.

According to a variant, where the crystalliser 11 has a rectangular cross-section, at least its wider sidewalls face independent cooling chambers 14 and circulation channels 21 having independent pressures and differences of pressures of the cooling fluid.

According to one form of embodiment of the invention (see FIGS. 6 and FIG. 7 regarding the corners 15*a*), the circulation channels 21 do not cooperate directly with the corners 15 of the crystalliser 11, which are not cooled by the cooling fluid running within the cooling chambers 14.

According to the invention a segment of an increased thickness 32 is included at the corners 15 of the crystalliser 11 so as to reduce the heat exchange with the cooling fluid.

In the embodiments shown in FIGS. 5*a*, 5*b* and 5*c* the circulation channels 21 cooperate with those segments 32 of an increased thickness included directly in the sidewalls of the crystalliser 11 so as to provide cooling also at the corners 15, but a cooling less intense than at the remaining parts of the sidewalls of the crystalliser 11.

According to the variant shown in FIG. 7 relating to the corner 15*b*, an auxiliary stiffening and/or alignment element 16 is included and cooperates with the corner 15*b* and defines therewith a channel 21 of reduced dimensions for circulation of the cooling fluid.

According to the variant shown in FIG. 7 relating to the corner 15*c*, the auxiliary stiffening and/or alignment element 16 defines with that corner 15*c* a geometry suitable to increase the turbulence of the circulating cooling fluid and to facilitate the alignment of the crystalliser 11.

In FIG. 7 at the corners 15*a*, and in FIG. 6*f*, the circulation channels 21 have at their lateral ends inclined walls 30 having an inclination which can be varied as required so as to modulate and graduate the heat exchange at the corners 15 of the crystalliser 11.

The segment 32 of an increased thickness can be embodied by means of stiffening and/or alignment elements 16 obtained wholly (16*a*–FIG. 6*c*) or partly (116*a*–FIGS. 6*b* and 6*d*) directly from the sidewalls of the crystalliser 11 or may consist of independent stiffening elements 16*b* (FIGS. 6*a*, 6*e* and 6*f*).

The stiffening and/or alignment elements 16, may also consist of a plurality of pieces.

The independent stiffening and/or alignment elements 16*b* can be associated with or rigidly connected to, by brazing for instance, the corners 15 of the crystalliser 11 according to the invention.

The stiffening and/or alignment elements 16*a*–116*a* provided in the sidewall of the crystalliser 11 can be conformed as a solid polygon or have a T-shape or another form.

Where the stiffening and/or alignment elements 16*b* are independent, they can be conformed as a "T", or an "L" or an "Ω" or can have other forms.

In the form of embodiment shown in FIGS. 6*d* and 6*f* the stiffening and/or alignment element, which in FIG. 6*d* is provided (116*a*) from the sidewall of the crystalliser 11, whereas in FIG. 6*f* it is an independent element 16*b*, is T-shaped and is inserted in a space 29 defined in the segment 32 of an increased thickness.

The cooling fluid may or may not run through the space 29.

The stiffening and/or alignment elements 16 perform the triple task of stiffening and of clamping the deformations of the crystalliser 11, of reducing the heat exchange at the corners 15 of the crystalliser 11 and of aligning the crystalliser 11.

The walls of the circulation channel 21 include disturbing elements 18 to increase the heat exchange between the cooling fluid and the crystalliser 11 in relation to the increase of heat flux to be removed which arises from elimination of the air interspaces between the sidewalls of the crystalliser 11 and the skin.

These disturbing elements 18 break up the fluid streams of the outermost layer of the fluid running against the sidewalls of the crystalliser 11 and cause the cooling fluid to run with a turbulent motion in the circulation channels 21 with a resulting increase of the heat exchange.

The disturbing elements 18 can be embodied with rough areas or hollows made in the outer surface 12 of the sidewalls of the crystalliser 11 and/or with rough areas or hollows made in the inner surface of the intermediate walls 20.

In this case the disturbing elements 18 contain a plurality of hollows 19 into which the cooling fluid penetrates and causes the breaking up of the outermost layer of the cooling fluid running against the outer surface 12 of the sidewalls of the crystalliser 11.

Figure 3:
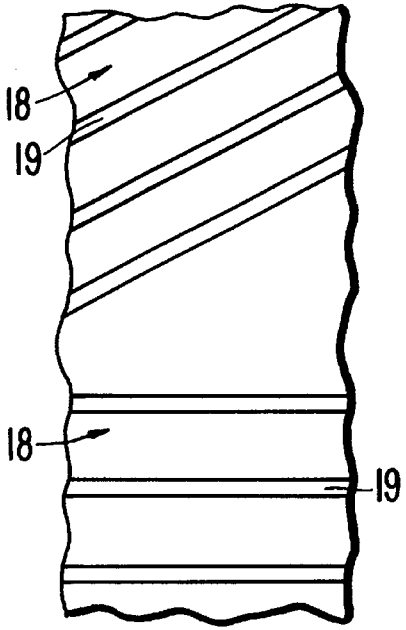
FIG. 3 shows the outer surface of the crystalliser of FIG. 2 along the line A—A of FIG. 2*a;*
Figure 4:
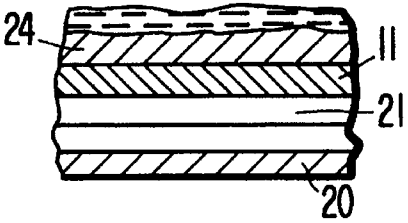
FIG. 4 shows a partial cross-section of a variant of the crystalliser of FIG. 3.

These hollows 19 may have a substantially horizontal or an inclined development (FIG. 3).

The hollows 19 are defined by a height and by a depth "a" of $\leqq 0.5$ mm. and by a distance of $\geqq 5$ mm. between one hollow and another.

Figure 2B:
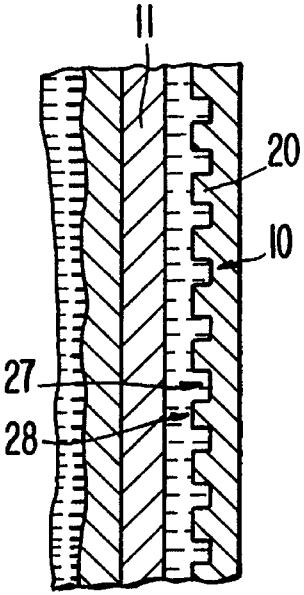
FIGS. 2*a* and 2*b* show in an enlarged scale two different partial vertical sections of the crystalliser of FIG. 1.
Figure 2A:
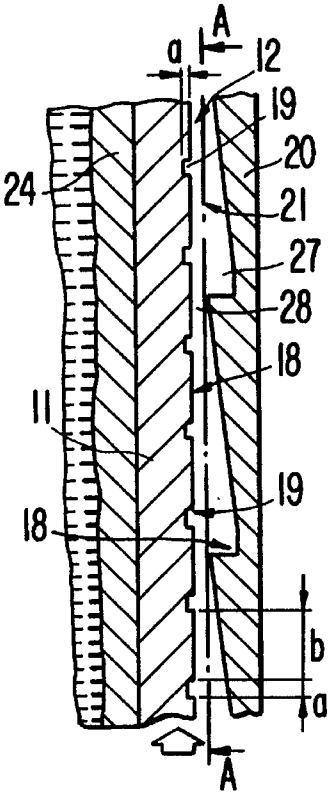

According to another embodiment of the invention (FIGS. 2*a* and 2*b*) the intermediate walls 20 have, on their inner surface facing the sidewalls of the crystalliser 11, disturbing elements 18 comprising alternate enlargements 27 and narrowings 28 for the purpose of causing in the circulating cooling fluid a required turbulence These enlargements 27 and narrowings 28 may have a polygonal development (FIG. 2*b*) or may have a development producing a Venturi effect (FIG. 2*a*), which makes the motion of the cooling fluid swirling and turbulent and thus enhances the heat exchange.

According to a further variant these rough surface areas on the outer surface 12 of the sidewalls of the crystalliser 11 and/or on the inner surface of the intermediate walls 20 are obtained by a treatment of sanding, shot-blasting or an analogous treatment.

We claim:

1. Method to increase heat exchange in the cooling and removal of heat from at least one sidewall of a crystalliser employed in the continuous casting of billets, blooms or slabs, comprising:

circulating cooling fluid through cooling chambers provided externally to the crystalliser, the cooling chambers containing intermediate walls creating circulating channels for the cooling fluid between the sidewalls of the crystalliser and the intermediate walls;

controlling at least one of (a) a transverse width or span of passage of at least one of the circulation channels and (b) a conformation of at least one interior wall of the at least one circulation channel; and controlling the pressure of the cooling fluid in the at least one circulation channel to provide a turbulent flow of the cooling fluid in the at least one circulation channel to increase the coefficient of heat exchange to a value greater than 40,000 $W/m^2K$.

2. Method as in claim 1, wherein the pressure of the cooling fluid at an inlet of the circulation channels is controlled to a value between 5 and 20 bar.

3. Method as in claim 2, wherein the pressure of the cooling fluid in an upper zone of the crystalliser extending between a meniscus of metal therein down to a vicinity of a point where forming skin of the billet, bloom or slab begins to shrink away from inside surfaces of the sidewalls of the crystalliser is between 3 and 15 bar.

4. Method as in claim 3, wherein the sidewalls at least at a part of the lower zone of the crystalliser extending from the upper zone to an end of the crystalliser have a thickness of 4–15 mm, whereby the pressure of the cooling fluid causes resilient deformation of the sidewalls until those sidewalls take up a position close to, or in contact with, the skin of the solidifying product.

5. Method as in claim 4, which the average heat flux removed in the lower zone of the crystalliser is always greater than 2.5 $MW/m^2$.

6. Mold for the continuous casting of billets, blooms or slabs, comprising:

a crystalliser having sidewalls within which the billets, blooms or slabs are cast, the sidewalls having a thickness of 4–15 mm;

a box-shaped structure provided externally to the crystalliser, whereby cooling chambers in which a cooling fluid flows are provided between the box-shaped structure and the sidewalls of the crystalliser;

intermediate walls provided in the cooling chambers adjacent the sidewalls of the crystalliser, thereby providing circulation channels for the cooling fluid between the sidewalls and the intermediate walls, wherein at least one interior wall of each circulation channel includes disturbing elements to disturb the flow of the cooling fluid therein to create a turbulent flow therein;

circulation means for circulating the cooling fluid in the cooling chambers and for controlling the pressure of the cooling fluid in the circulation channels to achieve a turbulent flow therein.

7. Mold as in claim 6, wherein the disturbing elements comprise a plurality of hollows provided at at least part of the outer surfaces of the sidewalls of the crystalliser in contact with the cooling fluid, the plurality of hollows being perpendicular or inclined to the direction of feed of the cooling fluid and having a height and a depth "a", wherein $a \leqq 0.5$ mm., and being at a distance apart "b", wherein $b \geqq 5$ mm.

8. Mold as in claim 6, wherein the disturbing elements are included in the inner surface of the intermediate walls facing towards the crystalliser and comprise alternate enlargements and narrowings.

9. Mold as in claim 6, wherein the disturbing elements comprise rough surface areas.

10. Mold as in claim 6, wherein a transverse width or span of passage of the circulation channels is 3 mm. at the most.

11. Mold as in claim 6, wherein the geometry of the circulation channels in their cross-section is varied at least at corners of the crystalliser.

12. Mold as in claim 6, further comprising stiffening elements associated with corners of the crystalliser.

13. Mold as in claim 12, wherein at least a portion of the stiffening elements.

14. Mold as in claim 12, wherein the stiffening elements are auxiliary external elements which cooperate with the corners of the crystalliser.

15. Mold as in claim 6, which at least part of the intermediate walls (20) can be moved as required in relation to the sidewalls of the crystalliser (11).

16. Mold as in claim 6, wherein the cooling fluid is water.

17. Mold as in claim 6, wherein the cooling fluid is water containing additives at a temperature down to –25° C./–30° C.

18. Mold as in claim 6, wherein the cooling fluid is glycol at a temperature between –10° C./–80° C.

19. Mold as in claim 6, wherein the cooling fluid comprises liquid gas at a temperature between –3° C. and –270° C.

20. Mold as in claim 8, wherein the disturbing elements further comprise a plurality of hollows provided at at least part of the outer surfaces of the sidewalls of the crystalliser in contact with the cooling fluid, the plurality of hollows being perpendicular or inclined to the direction of feed of the cooling fluid and having a height and a depth "a", wherein $a < 0.5$ mm., and being at a distance apart "b", wherein $b > 5$ mm.

21. Mold as in claim 6, wherein the sidewalls have a thickness of 4–10 mm.

22. Mold as in claim 16, wherein the crystalliser includes an upper zone extending between a meniscus of metal therein down to a vicinity of a point where forming skin of the billet, bloom or slab begins to shrink away from inside surfaces of the sidewalls of the crystalliser, and a lower zone extending from the upper zone to an end of the crystalliser, and wherein the circulation means control the pressure of cooling fluid at an inlet to the circulation channels at the lower zone to 5–20 bar and control the pressure of cooling fluid in the circulation channels at the upper zone to 3–15 bar.

* * * * *